United States Patent [19]

Nakahama

[11] Patent Number: 4,784,625

[45] Date of Patent: Nov. 15, 1988

[54] TILT LOCK MECHANISM FOR MARINE PROPULSION DEVICE

[75] Inventor: Ryoji Nakahama, Iwata, Japan

[73] Assignee: Sanshin Kobyo Kabushiki Kaisha, Hamamatsu, Japan

[21] Appl. No.: 36,173

[22] Filed: Apr. 8, 1987

Related U.S. Application Data

[63] Continuation of Ser. No. 668,388, Nov. 5, 1984, abandoned.

[30] Foreign Application Priority Data

Nov. 29, 1983 [JP] Japan ..... 58-223350

[51] Int. Cl.[4] ..... B63H 21/26

[52] U.S. Cl. ..... 440/61; 440/55; 440/56

[58] Field of Search ..... 440/55, 56, 61, 53

[56] References Cited

U.S. PATENT DOCUMENTS

| | | | |
|---|---|---|---|
| Re. 27,932 | 2/1974 | Mettetal, Jr. | 440/61 |
| 3,186,375 | 6/1965 | Cass | 440/55 |
| 3,285,221 | 11/1966 | North | 440/52 |
| 3,434,448 | 3/1969 | Woodfill | 440/56 |
| 3,434,450 | 3/1969 | McCormick | 440/52 |
| 3,722,455 | 3/1973 | Carpenter | 440/56 |
| 3,799,104 | 3/1974 | Kurling | 440/56 |
| 3,839,986 | 10/1974 | Meyer et al. | 440/61 |
| 3,863,592 | 2/1975 | Borst | 440/61 |
| 3,885,517 | 5/1975 | Borst et al. | 440/56 |
| 3,888,203 | 6/1975 | Lohse | 440/57 |
| 3,983,835 | 10/1976 | Hall | 440/61 |
| 3,999,502 | 12/1976 | Mayer | 440/52 |
| 4,052,952 | 10/1977 | Hale et al. | 440/52 |
| 4,064,824 | 12/1977 | Hall et al. | 440/61 |
| 4,308,018 | 12/1981 | Nakamura | 440/61 |
| 4,419,083 | 12/1983 | Taguchi | 440/61 |
| 4,490,120 | 12/1984 | Hundertmark | 440/61 |
| 4,493,659 | 1/1985 | Iwashita | 440/61 |
| 4,545,769 | 10/1985 | Nakahama et al. | 440/61 |
| 4,575,342 | 3/1986 | Nakahama et al. | 440/56 |

FOREIGN PATENT DOCUMENTS

| | | | |
|---|---|---|---|
| 57-95295 | 1/1982 | Japan | 440/61 |
| 122288 | 7/1983 | Japan | 440/56 |
| 58-174093 | 10/1983 | Japan | 440/61 |

*Primary Examiner*—Sherman D. Basinger
*Assistant Examiner*—Thomas J. Brahan
*Attorney, Agent, or Firm*—Ernest A. Beutler

[57] ABSTRACT

A tilt locking and shock absorbing arrangement for a marine outboard drive embodying a single cylinder and piston assembly for controlling the tilt and trim positions of the drive and for further absorbing shocks applied to it. An accumulator arrangement is provided having gas over oil and is valved into the system in such a way as to retard passage of the gas into the shock absorbing device per se and which will return any escaped gas back to the accumulator.

16 Claims, 5 Drawing Sheets

TILT LOCK MECHANISM FOR MARINE PROPULSION DEVICE

This is a continuation of U.S. patent application Ser. No. 668,388, filed Nov. 5, 1984, now abandoned.

BACKGROUND OF THE INVENTION

This invention relates to a tilt lock mechanism for marine propulsion device and more particularly to an improved hydraulic tilt locking mechanism.

In connection with outboard drives such as either an outboard motor or the outboard drive portion of an inboard/outboard drive, it is the normal practice to provide angular adjustment of the outboard drive about a horizontally disposed tilt axis for achieving trim adjustment. In addition, it is also the normal practice to permit the outboard drive to be tilted up completely out of the water under some conditions. In addition, it is desirable to provide an arrangement wherein the outboard drive is permitted to pop up when an underwater obstacle is struck so as to prevent damage. The mechanism should, once the underwater obstacle is cleared, permit the outboard drive to return to its previously set trim position. Furthermore, when reverse thrust are encountered, it is desirable if the device is operative to hold the outboard drive against popping up under such reverse drive thrusts. Although many of these advantages can be enjoyed in conjunction with the use of hydraulic shock absorbing devices interposed between the outboard drive and the transom of the associated watercraft, the hydraulic shock absorbing mechanisms should not interfere with the operator's ability to tilt the outboard drive up to its out of the water condition and also to permit it to return to its normal condition.

In one of the more commonly used type of arrangements, a hydraulic cylinder and piston assembly is interposed between the outboard drive and the transom and embodies a shock absorbing valving arrangement so as to hold the outboard drive against reverse thrusts and also to permit it to pop up when the underwater obstacle is encountered. With such arrangements, the piston rod extends through one chamber of the hydraulic cylinder piston assembly and an arrangement must be employed to compensate for the changes in volume of the piston rod, depending upon the axial position of the associated piston. It is normally the practice to employ an inert gas acting over the hydraulic fluid so as to provide this compensation. Such arrangements, however, have a tendency to permit the inert gas to enter into the shock absorbing arrangement per se and thus significantly diminish the ability of the unit to resist reverse thrusts and absorb impacts.

In the copending application entitled "Tilt Lock Mechanism For Propulsion Device", Ser. No. 565,271, filed Dec. 27, 1983 in my name and the name of Takashi Iwashita and assigned to the assignee of this application, there is disclosed a tilt locking mechanism embodying an accumulator having an inert gas arrangement and disposed in such a manner so as to reduce the likelihood of the inert gas entering the hydraulic cylinder and piston assembly of the main unit. Although the arrangement shown in that device is particularly useful, it has been found that under some conditions, it may also permit the entry of the inert gas into the operating cylinder and piston assembly where it may become trapped.

It is, therefore, a principal object of this invention to provide an improved tilt locking mechanism for an outboard drive that employs a gas over oil arrangement and in which the gas cannot enter into the shock absorbing system.

It is a further object of this invention to provide a hydraulic shock absorbing assembly for an outboard drive using a gas accumulator to compensate for changes in volume of one of the shock absorbing chambers due to the use of a piston rod and in which the gas is effectively isolated from the shock absorbing arrangement.

SUMMARY OF THE INVENTION

This invention is adapted to be embodied in a tilt locking and shock absorbing arrangement for a marine outboard drive comprising a drive member supported for tilting movement relative to a hull of an associated watercraft about a substantially horizontally disposed tilt axis. A hydraulic assembly is incorporated that comprises a cylinder, a piston slidably supported in the cylinder and defining first and second chambers, and a piston rod affixed to the piston and extending through one of the chambers. The hydraulic assembly is operatively interposed between the hull and the drive member for relative movement of the piston and cylinder upon tilting movement of the drive member about the tilt axis. Passage means extending between the first and second chambers and valve means in the passage means control the flow between the first chamber and the second chamber. In accordance with the invention, an accumulator is in communication with the passage means for compensating for the changes in the volume of the fluid displaced by the piston rod from the one chamber. The accumulator is in the flow path through the passage means for flow through the accumulator upon flow between said chambers through said passage means.

BRIEF DESCRIPTION OF THE DRAWINGS

FIG. 6 shows the popping up under normal running conditions.

FIG. 7 shows the return to the normal running condition from the popped up condition.

FIG. 8 shows operation in a shallow water condition.

FIG. 9 shows popping up from the shallow water condition.

DETAILED DESCRIPTION OF THE PREFERRED EMBODIMENT

Figure 1:
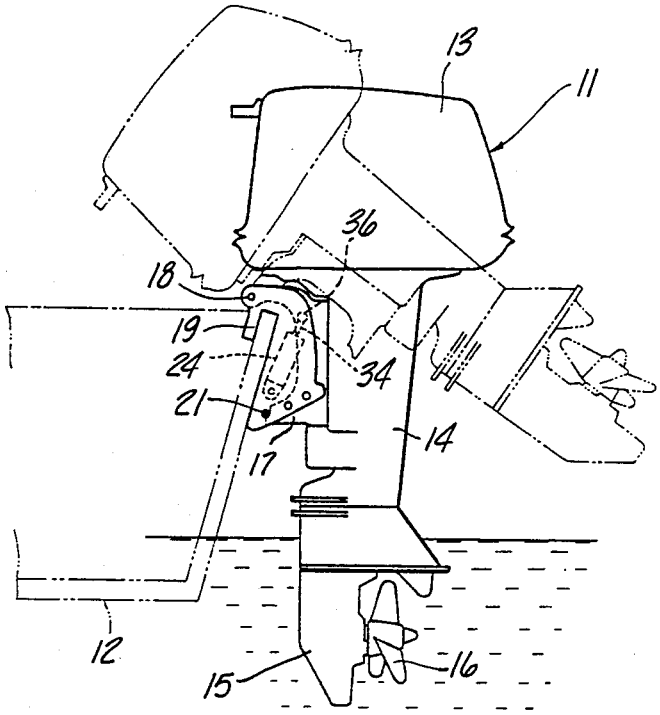
FIG. 1 is a side elevational view of an outboard motor embodying a tilt lock mechanism constructed in accordance with the invention, attached to the transom of an associated watercraft (shown in phantom). The solid line view shows the motor in its normal running condition while the phantom line view shows the motor in a tilted up condition.
Figure 2:
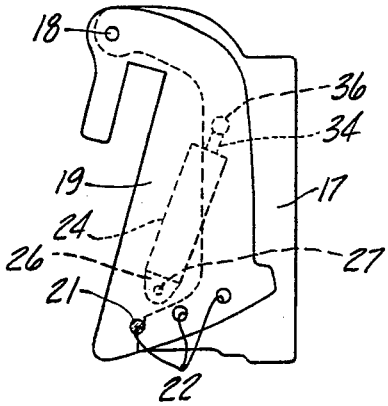
FIG. 2 is an enlarged side elevational view of the tilt mechanism and associated tilt lock mechanism.

Referring first to FIGS. 1 and 2, an outboard motor is identified generally by the reference numeral 11. Except with respect to the tilt locking mechanism, the outboard motor 11 and its association with a watercraft, shown in phantom and identified by the reference numeral 12, is generally conventional. The outboard motor 11 includes a power head 13 in which an internal combustion engine of a known type is supported. The engine, which is not shown, has an output shaft that drives a drive shaft (not shown) that extends through and is journaled in a drive shaft housing 14 and which terminates at a forward, reverse transmission located in a lower unit 15. The transmission, in turn, drives a propeller 16.

The drive shaft housing 14 carries a steering shaft that is journaled for steering movement about a generally vertically extending axis by means of a swivel bracket 17. The swivel bracket 17 is, in turn, supported for pivotal movement about a generally horizontally extending axis by means of a pivot pin 18 which is, in turn, affixed to clamping bracket 19. The clamping bracket is, in turn, affixed in a known manner to the hull of the watercraft 12.

A trim pin 21 is received in selective pairs of aligned apertures 22 formed in the clamping bracket 19. The swivel bracket 17 has a forwardly extending edge 23 that is adapted to engage the trim pin 21 so as to determine the normal trim condition of the motor 11 about the pivot pin 18.

Figure 3:
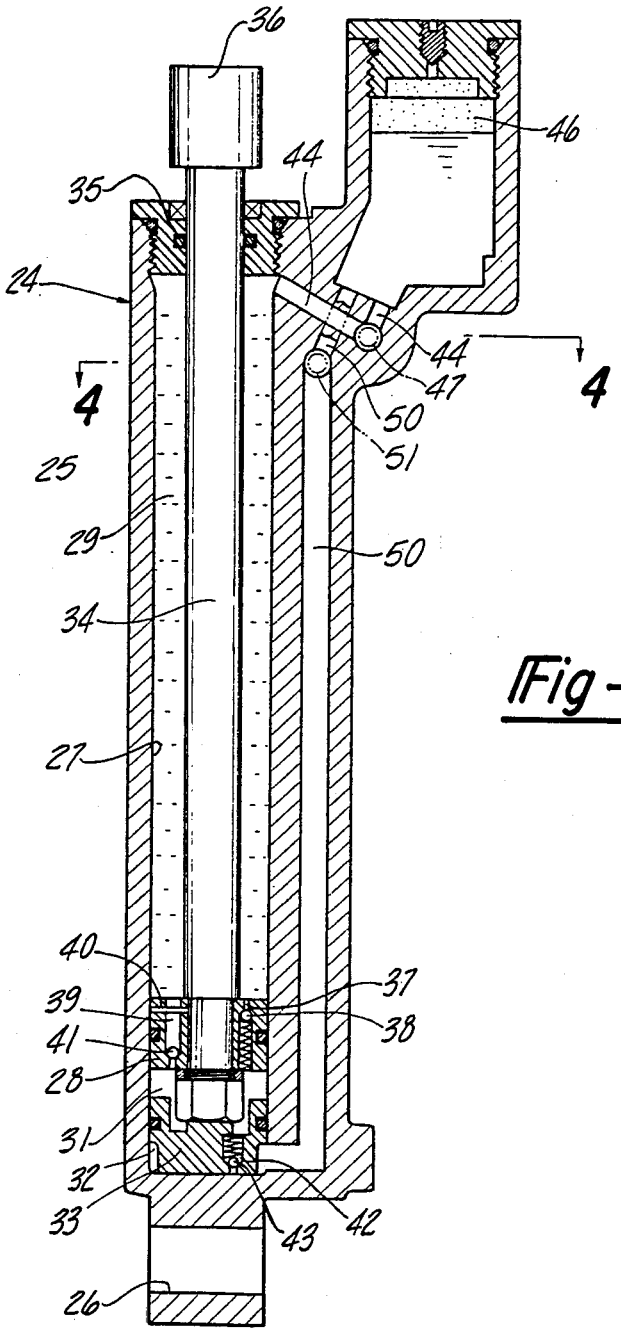
FIG. 3 is an enlarged cross-sectional through the tilt locking mechanism.
Figure 4:
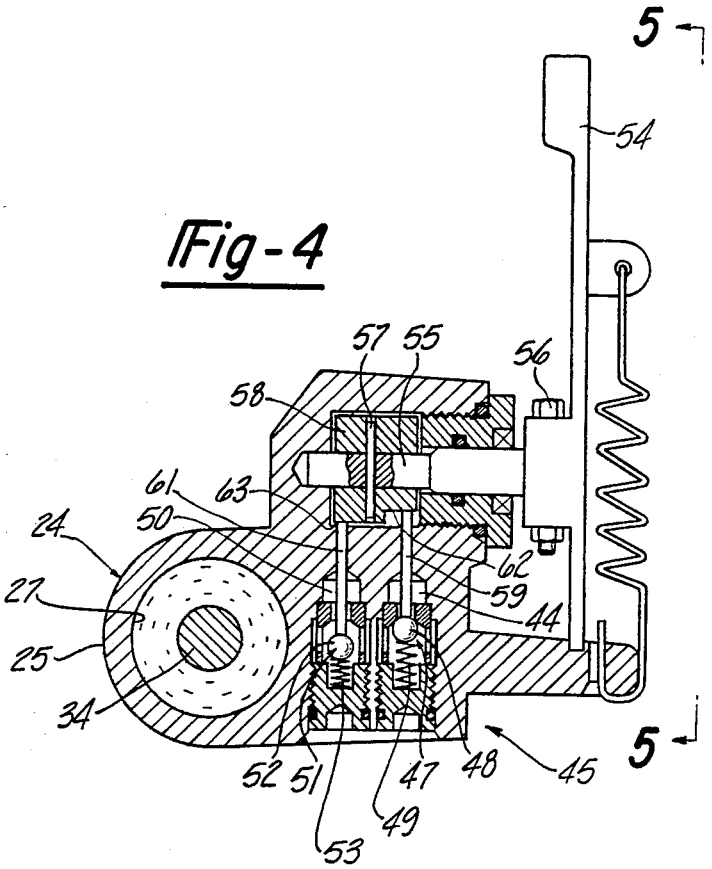
FIG. 4 is a cross-sectional view taken along the line 4-4 of FIG. 3.
Figure 5:
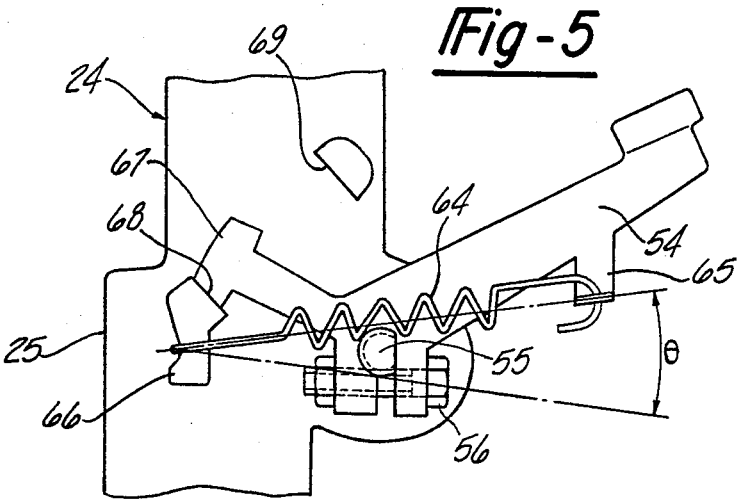
FIG. 5 is a side elevational view looking in the direction of the line 5—5 in FIG. 4.

A combined tilt locking and shock absorbing assembly, indicated generally by the reference numeral 24 and shown in most detail in FIGS. 3 through 5 and schematically in FIGS. 6 through 9, is incorporated for controlling the piston of the motor 11, as will become apparent. Referring now to these additional figures, the mechanism 24 includes a cylinder housing assembly 25 carrying an integral trunnion 26 at its lower end. The trunnion 26 affords a means by which a pivot pin 27 can pivotally connect the assembly 24 to the clamping bracket 19 in a suitable manner.

The cylinder housing assembly 25 has a cylinder bore 27 in which a first piston 28 is supported for reciprocation. The piston 28 divides the cylinder bore 27 into an upper chamber 29 and a lower chamber which is, in turn, divided into an upper portion 31 and a lower portion 32 by means of a floating piston 33 that is slidably supported in the bore 27. A piston rod 34 is affixed to the piston 28 and extends through the chamber 29. A suitable seal 35 surrounds the upper end of the piston rod 34 so as to prevent leakage of a hydraulic fluid that is contained within the chamber 29 and the lower chamber portions 31 and 32.

The exposed end of the piston rod 34 is formed with a clevis 36 to afford a connection to a pivot pin to provide a pivotal connection to the swivel bracket 17.

A first absorber passage 37 extends through the piston 28 so as to permit flow from the chamber 29 to the upper portion 31 of the lower chamber. A pressure responsive one-way absorber valve 38 is provided in the passage 37 so as to permit flow from the chamber 29 to the lower portion 31 while precluding flow in the opposite direction.

A relief passage 39 also extends through the piston 28 so as to communicate the chamber 29 with the lower chamber upper portion 31. A check valve 41 is provided in the passage 39 so as to permit flow from the lower portion 31 to the chamber 29 while precluding reverse flow. The valve 41 is biased only by its own weight and thus opens at a significantly lower pressure than the valve 38. The weight of the motor 11 is sufficient so as to cause the valve 41 to open, as will become apparent. A pin 40 extends across the upper end of passage 35 to retain the ball check valve 41 therein.

A passage 42 extends through the piston 33 between the lower chamber portions 31 and 32. A pressure responsive check valve 43 is positioned in this passage so as to permit flow only from the portion 32 to the portion 31 while precluding any reverse flow.

A bypass passage 44 extends from the upper portion of the upper chamber 29 to a manually operated control valve assembly, indicated generally by the reference numeral 45. The valve assembly 45, among other functions, controls the flow between the passage 44 and a first port of an accumulator, indicated generally by the reference numeral 46, which communicates with the passageway 44 in a manner to be described so as to compensate for changes in the volume of the fluid in the chamber 29 displaced by the piston rod 34 without causing gases to enter into the assembly 24. Physically, the accumulator chamber 46 and control valve assembly 45 are all contained within the housing assembly 25 to afford a compact construction.

The manually operated control valve assembly 45 includes a first check valve 47 having a ball-type valve element 48 that is urged by a spring 49 to a closed position that precludes communication from the chamber 29 to the accumulator 46. However, upon the exertion of sufficient pressure difference, the ball valve 48 can open so as to permit flow from the accumulator 46 to the chamber 29, as will become apparent.

The control valve assembly 45 controls frow from the lower chamber portion 32 to a second port of the accumulator 46 through a passage 50 by means of a second check valve assembly 51. The check valve assembly 51 includes a ball-type check valve 52 that is urged by a coil compression spring 53 toward a closed position wherein flow between the accumulator 46 and lower chamber portion 32 is precluded. Fluid pressure can unseat the ball 52 under certain circumstances, as will be described, so as to permit flow from the accumulator 46 into the lower chamber part 32.

The accumulator 46 is partially filled with hydraulic fluid and is pressurized by an inert gas such as nitrogen. In addition to serving to compensate for the changes in volume resulting from displacement of the piston rod 34, the accumulator 46 provides a flow path between the conduits 44 and 50 under control of the valve assembly 45 as will become apparent.

The valve assembly 45 also includes a manual operator having a manually operable lever 54 that is fixed to shaft 55 by a clamping portion 56. The shaft 55 is connected by a pin 57 to a cam 58 which, in turn, operates a pair of push rods 59 and 61 so as to selectively hold the respective balls 48, 52 of the check valve assemblies 47 and 51 in their opened positions. The cam 58 has a first lobe 62 that cooperates with the push rod 59 and a second lobe 63 that cooperates with the push rod 61. The lobes 62 and 63 are generally circular but are offset relative to each other.

The lever 57 is pivotally supported for rotation about an axis defined by the shaft 55. A tension spring 62 is engaged at one end with a tang 65 on the lever 54. The other end of the spring 64 is engaged with a lug 66 formed on the housing 25. The lever 54 has a stop portion 67 that is adapted to engage either of a pair of stops 68 and 69 formed on the housing 25 and disposed on opposite sides of the portion 67. The spring 64 acts in an over center relationship as the lever 54 is rotated between the position shown in FIG. 5 wherein the ball check valve 51 is held in an opened position and the ball check valve 47 operates normally and another position wherein the ball check valve 47 is held in its opened position and the ball check valve 51 acts normally.

Figure 6:
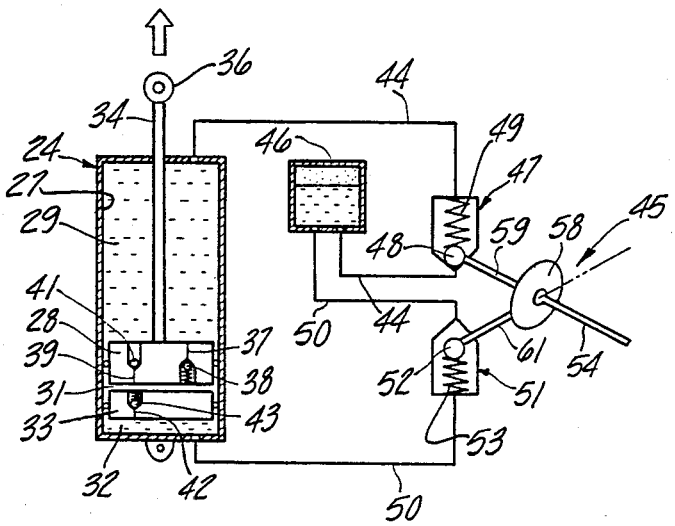
FIGS. 6 through 9 are cross-sectional, partially schematic views of the tilt locking mechanism under various conditions.
Figure 7:
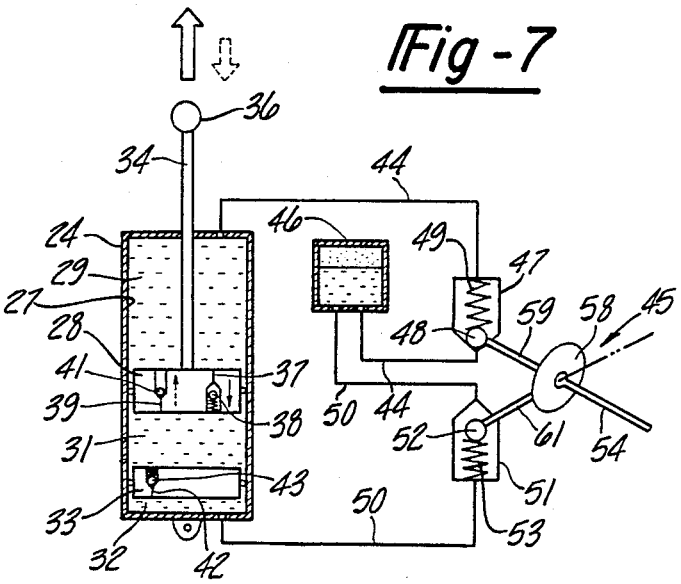

FIGS. 4, 6 and 7 show the valve assembly 45 as it appears when set manually for normal running condition. In this condition, the lever 54 is positioned so that the push rod 59 will permit the ball 48 of the check valve 47 to be retained in its closed position by the spring 49. On the other hand, the push rod 61 will engage the ball 52 of the check valve 51 so as to hold the check valve 51 in an opened condition. Thus, the check valve 47 controls the direction of flow and the flow conditions through the passage 44.

The position of the floating piston 33 will determine the at rest position of the piston 28 and, accordingly, the trim angle of the motor 11 about the pivot pin 18. The valve 43 in the floating position 33 has sufficient force required to open it so as to resist the weight of the motor 11 and hold it in the adjusted trim condition.

When operating in the reverse mode, the motor 11 tends to tilt up about the pivot pin 18. This movement causes a force to be exerted on the piston rod 34 which tends to cause it and the piston 28 to be drawn upwardly. However, the setting of the absorber valve 38 is such that these normal reverse thrust forces are resisted and the motor 11 will be held against popping up under reverse drive condition.

When operating in a forward direction and if an underwater obstacle is struck by the lower unit 15 with sufficient force, the piston rod 34 will exert sufficient force on the piston 28 so as to overcome the action of the absorber valve 38 and permit the piston 28 to move upwardly and the motor 11 to pop up. The absorber valve 38 will, however, offer some resistance to this movement. Fluid cannot flow from the chamber 29 through the passage 44 since the increase in pressure in the chamber 29 will hold the check valve assembly 47 and, more particularly, its ball 48 in the closed position. When the struck underwater obstacle provides sufficient force, the piston 28 will move upwardly and fluid will flow through the absorber valve 38 from the chamber 29 to the lower chamber part 31 above the floating piston 33. Because less of the piston rod 34 is immersed in the chamber 29, it will be necessary to add further fluid to the area below the piston 28 so as to accommodate for these volume changes. This fluid will be supplied from the accumulator 46 through the passage 44 and open check valve 51 to the area beneath the floating piston 33. Thus, the floating piston 33 will also move up slightly when the motor 11 pops up as shown in FIG. 7.

Once the underwater obstacle has been cleared, the weight of the motor 11 acting on the piston rod 34 and piston 28 will cause the return valve 11 to open and permit hydraulic fluid to flow back to the chamber 29 from the lower chamber part 31 through the return passage 39. As the motor lowers, as shown in the broken arrow in FIG. 7, the floating piston 33 will again move downwardly so as to displace fluid back to the accumulator 46 through the open check valve 51 so as to again compensate for the variation in volume displaced in the chamber 29 by the piston rod 34. Once the motor reaches the preset trim position, the downward movement will discontinue. During the downward movement, there is insufficient pressure generated on the underside of the floating piston 33 so as to cause the check valve 47 to open. Hence, no fluid will be returned to the chamber 29 through the passageway 44.

Figure 8:
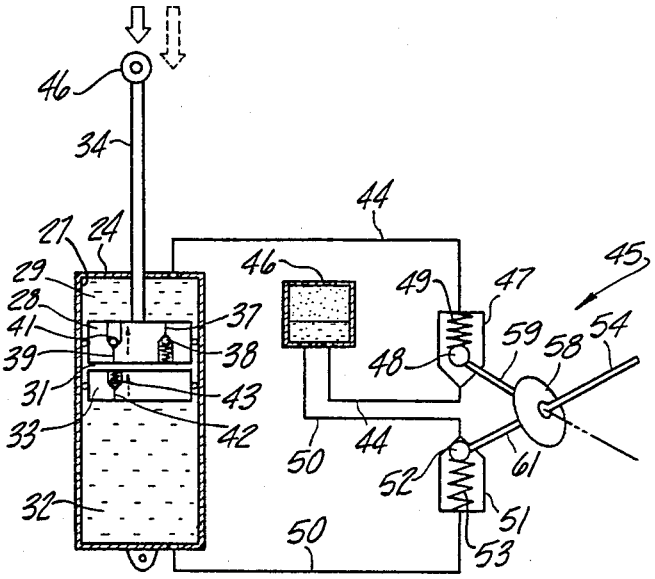
Figure 9:
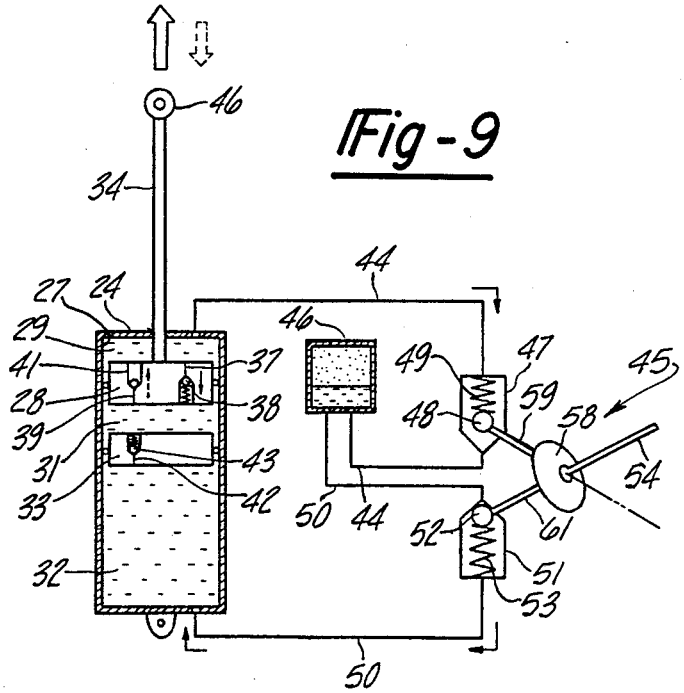

It it is desired to manually change the trim position of the motor 11 so as to either set the motor 11 for a shallow water running condition or so as to tilt it up out of the water, the manually operated valve 45 is moved from its normal position, as shown in FIGS. 4 through 7, to its trim adjusting position, as shown in FIGS. 8 and 9. This causes the ball 48 of the check valve assembly 47 to be unseated and, at the same time, permit seating of the ball 52 of the check valve assembly 51. In this condition, fluid may flow between the chamber 29 and the lower part 32 through the passageway 44, accumulator 46 and conduit 50 under the control of the check valve assembly 51. That is, fluid may flow from the chamber 29 to the lower chamber part 32 if sufficient force is exerted so as to unseat the ball 52 of the check valve assembly 51. Flow in the opposite direction is, however, prevented.

When the manually operated valve 45 is set in the trim adjusting position, the trim of the motor 11 may be adjusted by the operator exerting a force on the motor 11 tending to rotate it in a counterclockwise direction about the pivot pin 18. This causes the piston rod 34 and piston 28 to move upwardly in the cylinder bore 27. Upon such upward movement, the fluid from the chamber 29 will be urged into the line 44 and will act upon the check valve 51 so as to unseat the ball 52 and permit the fluid to flow to the lower chamber part 32 through the accumulator 46. This flow of fluid causes the floating piston 33 to follow the piston 28 in an upward direction until the desired trim angle is reached. The accumulator 46 will again cause fluid to enter the system so as to compensate for changes in volume displaced by the piston rod 34 in the chamber 29. When the desired trim position is reached, the operator need merely reduce or release the force he has applied to the motor 11. Thus, a downward force will be exerted upon the piston rod 34 which tends to cause the piston 28 to move downwardly in the bore 27. The piston 28 will, however, engage the piston 33 and any force tending to cause it to move downwardly will be resisted by the pressure necessitated to open the check valve 43 in the piston 33. This is greater than the force of the weight of the motor and, accordingly, the motor will be held in the tilted up condition.

Assuming that the motor has not been tilted up out of the water, but has only been tilted to a shallow trim condition, the device 24 will function so as to permit the motor to pop up when an underwater obstacle is struck, when traveling in a forward direction and, also, will function to prevent the motor 11 from popping up under reverse thrusts much the same as in conjunction with the description of FIGS. 6 and 7. Since the operation under these modes is believed to be readily apparent, it will not be described again in detail. However, FIG. 9 does show the condition when the motor 11 has popped up. Under this condition, fluid will flow through the absorber valve 38 from the chamber 29 to the lower chamber part 31. Again, the accumulator 46 will act so as to compensate for changes in volume displaced by the piston rod 34 in the chamber 29. Fluid may also flow from the chamber 29 to the lower chamber part 32 through opening of the check valve if sufficient force is encountered. When the underwater obstacle is cleared, the motor 11 will again return to the trim adjusted position. However, it will be at a slightly higher level due to the displacement of fluid through the passage 44 to the underside of the floating piston 33. The floating piston 33 will be held in a slightly elevated position under this return condition.

It should be noted that all of this operation may be accomplished with the manually operated valve 45 still held in the trim adjusted position. In this condition, if it is desired to tilt the motor back down to a lower trim adjusting condition, a very high forward thrust may be exerted by accelerating the motor 11. This high force, as indicated by the broken line arrow in FIG. 8, will cause the piston 28 to exert sufficient force on the piston 33 so as to cause the check valve 43 in the floating piston 33 to open and, accordingly, open the valve 41 in the piston 28 so that the pistons 28 and 33 can move downwardly together.

It should be readily apparent from the foregoing description that a relatively simple arrangement has been provided wherein an accumulator chamber 44 communicates with the shock absorbing mechanism in such a way that the gas which acts to compensate for the changes in volume displaced by the piston rod 34 cannot enter the shock absorbing mechanism. This is achieved through the unique placement of the communication of the accumulator 46 with the control valve 45 between the two check valves 47 and 51 and by placing the accumulator 46 directly in the flow circuit. In addition, any gas that may have escaped from the accumulator chamber 46 and entered the chambers 29 or lower chamber portion 32 will be returned back to the accumulator 46 since it is in the fluid circuit. Thus, gas cannot become permanently entrapped in the device 24.

Although this embodiment tends to retard the escape of gas from the accumulator 46, the escape may be further retarded through the use of a floating piston in the accumulator 46. Various other changes and modifications may be made, without departing from the spirit and scope of the invention, as defined by the appended claims.

I claim:

1. In a tilt locking and shock absorbing arrangement for a marine outboard drive comprising a drive member supported for tilting movement relative to a hull of an associated watercraft about a substantially horizontally disposed tilt axis, a hydraulic assembly comprising a cylinder and a piston slidably supported in said cylinder and defining first and second chambers, a piston rod affixed to said piston and extending through one of said chambers, means for operatively interposing said hydraulic assembly between hull and said drive member for relative movement of said piston and said cylinder upon tilting movement of said drive member about said tilt axis, passage means extending between said first and second chambers, and defining a single fluid path therebetween valve means in said passage means for controlling the flow between said first chamber and said second chamber, said valve means comprising first check valve means in said passage means for permitting flow from said first chamber to said second chamber and for precluding flow from said second chamber to said first chamber, second check valve means in said passage means for permitting flow from said second chamber to said first chamber and for precluding flow from said first chamber to said second chamber, and control means for selectively opening one of said check valve means so that the other of said check valve means controls the flow through said passage means, the improvement comprising an accumulator having a first port comunicating solely with said first check valve means and a second port communicating solely with said second check valve means such that said fluid path includes said accumulator, said accumulator compensating for the changes in the volume of the fluid displaced from said one chamber by said piston rod.

2. In a tilt locking and shock absorbing arrangement as set forth in claim 1 further including damping means for permitting flow from the first chamber to the second chamber upon the application of a predetermined force tending to cause the drive member to tilt up about the tilt axis and for permitting flow from the second chamber to the first chamber upon the exertion of a predetermined force to effect tilt down of the drive member.

3. In a tilt locking and shock absorbing arrangement as set forth in claim 2 wherein the damping means comprises a first passage including pressure responsive absorber valve means for permitting flow from said first chamber to said second chamber upon the application of a predetermined force tending to cause said drive member to tilt up about said tilt axis, and a second passage including pressure responsive relief valve means for permitting flow from said second chamber to said first chamber upon the exertion of a predetermined force to effect tilt down of said drive member.

4. In a tilt locking and shock absorbing arrangement as set forth in claim 3 wherein the control means includes a single manually operable means for selectively opening each of the check valve means.

5. In a tilt locking and shock absorbing arrangement as set forth in claim 4 wherein the single manually operable means is operative to maintain a selected one of the check valve means in its open position and for permitting normal check valve operation of the other of the check valve means.

6. In a tilt locking and shock absorbing arrangement as set forth in claim 5 further including a second piston slidably supported in said cylinder on the side opposite said piston rod and adapted to engage the first mentioned piston for fixing the trim position of the drive member.

7. In a tilt locking and shock absorbing arrangement as set forth in claim 3 wherein the control means is movable between a first position wherein one of the check valve means is held in an opened condition and the other of the check valve means is permitted to function normally and a second position wherein the other of the check valve means is held in an opened position and the one of the check valve means is operative to perform its normal check valve function.

8. In a tilt locking and shock absorbing arrangement as set forth in claim 7 wherein the control means includes a single manually operative means for selectively opening each of the check valve means.

9. In a tilt locking and shock absorbing arrangement as set forth in claim 8 wherein there is a check valved passage extending through the second piston for permitting flow in one direction therethrough while precluding flow in the opposite direction.

10. In a tilt locking and shock absorbing arrangement as set forth in claim 1 wherein the control means includes a single manually operable means for selectively opening each of the check valve means.

11. In a tilt locking and shock absorbing arrangement as set forth in claim 10 further including a second piston slidably supported in said cylinder on the side opposite said piston rod and adapted to engage the first mentioned piston for fixing the trim position of the drive member.

12. In a tilt locking and shock absorbing arrangement as set forth in claim 10 wherein the single manually operable means is operative to maintain a selected one of the check valve means in its open position and for permitting normal check valve operation of the other of the check valve means.

13. In a tilt locking and shock absorbing arrangement as set forth in claim 12 further including a second piston slidably supported in said cylinder on the side opposite said piston rod and adapted to engage the first mentioned piston for fixing the trim position of the drive member.

14. In a tilt locking and shock absorbing arrangement as set forth in claim 1 wherein the control means is movable between a first position wherein one of the check valve means is held in an opened condition and the other of the check valve means is permitted to function normally and a second position wherein the other of the check valve means is held in an opened position and the one of the check valve means is operative to perform its normal check valve function.

15. In a tilt locking and shock absorbing arrangement as set forth in claim 14 further including a second piston slidably supported in said cylinder on the side opposite said piston rod and adapted to engage the first mentioned piston for fixing the trim position of the drive member.

16. In a tilt locking and shock absorbing arrangement as set forth in claim 15 wherein there is a check valve passage extending through the second piston for permitting flow in one direction therethrough while precluding flow in the opposite direction.

* * * * *